United States Patent [19]

Young, Jr.

[11] 4,083,458

[45] Apr. 11, 1978

[54] SHELF-SUPPORTING STANDARDS

[76] Inventor: Bruce Young, Jr., 105 Masters Rd., Hixson, Tenn. 37343

[21] Appl. No.: 679,794

[22] Filed: Apr. 23, 1976

[51] Int. Cl.[2] ..... A47F 5/00

[52] U.S. Cl. ..... 211/187; 108/111; 211/183; 248/220.1

[58] Field of Search ..... 211/187, 134, 190, 193, 211/183; 108/108, 109, 111; 248/220.1, 243; 52/281, 282

[56] References Cited

U.S. PATENT DOCUMENTS

| | | | |
|---|---|---|---|
| 967,383 | 8/1910 | Hunter | 248/220.1 |
| 1,172,260 | 2/1916 | Crist | 248/220.1 |
| 1,917,917 | 7/1933 | Bales | 211/134 |
| 3,014,596 | 12/1961 | Gingher et al. | 248/220.1 X |
| 3,614,044 | 10/1971 | Bard | 108/108 X |
| 3,807,320 | 4/1974 | Textoris | 211/187 X |
| 3,843,191 | 10/1974 | Rediger et al. | 52/282 X |

FOREIGN PATENT DOCUMENTS

| | | | |
|---|---|---|---|
| 1,947,508 | 7/1970 | Germany | 248/243 |

*Primary Examiner*—Roy D. Frazier
*Assistant Examiner*—Robert W. Gibson, Jr.
*Attorney, Agent, or Firm*—Shoemaker and Mattare, Ltd.

[57] ABSTRACT

A wall mounted standard for connecting shelf-supporting brackets to a wall. One form of the standard comprises means for connecting together two aligned wall-forming panels, while another form of the standard is used to connect a pair of panels which are oriented at right angles to each other to form a corner connection. Other forms of the standard are suspended from the top of a wall.

6 Claims, 9 Drawing Figures

SHELF-SUPPORTING STANDARDS

BACKGROUND OF THE INVENTION

The present invention relates to article displaying and, more particularly, to shelf-supporting devices.

Bracket supported shelves are a convenient method of storing and/or displaying items such as merchandise, books, and the like. In most of such storage and/or display set-ups, a plurality of vertically aligned brackets are generally supported by a plurality of horizontally spaced standards which are generally attached to a wall in a vertical orientation. These brackets then support the shelves in the desired positions.

Those who display and/or store items, such as merchandise, books, and the like, on shelves in such set-ups often find it necessary or desirable to alter an existing set-up. This alteration often involves adding new shelves, changing the wall arrangement by adding or removing some of the panels forming the wall, removing shelves, adding or removing standards, or the like. The display set-up is altered to change its appearance, create new floor space, accommodate new items, or the like.

Heretofore, display set-up alteration has been difficult because of the difficulty in moving panels or shelves from their existing positions. This difficulty often requires extensive carpentry work and arises because the panels and wall attached standards used to support the shelf brackets are attached together in a manner which renders it difficult to alter the existing display unit set-up. Often this connection of panels is essentially permanent wherein panels are connected together and the standards are affixed to those connected panels. Furthermore, the connections between the panels, and between the panels and the standards are often in inaccessible locations thus further imparing the alteration process.

Almost all of the known bracket supporting standards are attached to an already assembled wall; i.e., a wall that has the panels thereof connected together in an essentially permanent manner.

However, there are some standards that serve a dual function of supporting brackets and connecting wall panels together. However, these standards are difficult to assemble and, once assembled, are extremely difficult, if not impossible, to disassemble. Furthermore, these panel connecting standards are attached to the panels in a manner such that there is no latitude as to where the panels can be connected to the standard. Thus, a particular standard can only be used with certain panels, and there is no room for variation in display height or configuration. A further drawback to known standards arises because they are not capable of connecting together two panels which are at right angles to each other, i.e., a corner-forming connection. Still another drawback to the known standards arises because they can only be oriented one way. That is, they cannot be inverted, tilted, or the like, to accommodate unique display set-ups.

SUMMARY OF THE INVENTION

A display set-up utilizing the wall standard embodying the teachings of the present invention can be easily assembled, disassembled, and rearranged.

For convenience, the present invention will be described in relation to a display set-up, however, the devices embodying the teachings of the present invention can also be used in storage unit set-ups, or the like. Thus, the display set-up is used for the sake of convenience and is not intended to be limiting.

In one embodiment of the present invention, a wall mounted standard comprises an elongate body with a plurality of rows of aligned bracket receiving holes or slots defined in the face thereof. A plurality of anchor plates are affixed to the back of the body to attach the body to a pair of abutting wall panels in a manner such that the wall panels are connected together via the standard. Attaching means, such as anchor bolts, can be used to attach the standard to the wall panels.

The anchor plates are welded or otherwise affixed to the standard at suitable locations thereon. Thus, a standard can be cut to accommodate panels of varying heights, and can be easily attached to a wall panel as the bolts, or the like, can be inserted from convenient locations.

The plurality of rows of bracket receiving holes enable the standard to be used between a pair of aligned shelves, or to support a single short shelf adjacent a long shelf, or the like, thus providing versatility to the display set-up.

Another embodiment of the present invention comprises an elongate body having a pair of L-shaped halves. The base of each of the L-shaped halves forms a flange having a plurality of holes defined therein through which attaching means are fit. The flanges of the two halves are oriented at essentially right angles with respect to each other. Thus, panels oriented at right angles with respect to each other can be connected together by the wall standard to form a corner connection for a display set-up. Again, connection to the wall panels is easy, as the fastening means attach the wall standard to the wall at convenient and easily accessible positions.

Another embodiment of the corner standard includes a J-shaped elongate body with a plurality of aligned bracket receiving slots in the short leg of the J. The other leg of the J, as well as the bight portion, which is essentially flat, has screw-receiving holes defined therein for attaching the standard to a pair of panels which are at essentially right angles to each other to form a corner of a display set-up.

A further embodiment of the present invention comprises an elongate body having a plurality of rows of aligned holes in the front face thereof, and is pendently suspended from the tail of a hooklike hanger. The hanger is in the form of an inverted J having an essentially straight bight portion, and is slidably mounted on top of a wall panel. The elongate body can thus be moved along the face of a panel into the desired position, whereat it can be attached to the panel, or panels. The face of this embodiment, as well as the first-mentioned embodiment, can have defined therein screw-receiving holes for further attaching the body to a panel or panels.

All of the above-mentioned embodiments can be attached on either side of a panel to provide dual displays, or to further reinforce a single display set-up.

Furthermore, all of the above-mentioned standards can be oriented in a variety of ways to accommodate unique or unusual display set-ups. Even though oriented in unusual positions, all of the standards embodying the present invention are easily attached to the wall panels, and can be altered easily to accommodate displays of varying heights.

The versatility of the standards embodying the present invention is further enhanced because they can be interchanged with each other. Thus, there are no "rights", "lefts", "tops" or "bottoms", per se, but one single design can be used on either side, or either end of a display set-up.

Another bracket supporting standard includes an elongate body having a block-L shape in transverse cross-section. The body has a plurality of aligned holes defined in one portion of the face thereof for receiving the bases of a plurality of hangers, and an open back for receiving the top of a panel. Another portion of the face is offset from the just-mentioned portion and forms a base against which the hanger bears for support. The rear lip of the body can be notched to receive a panel intersecting the panel upon which the standard is seated.

OBJECTS OF THE INVENTION

It is therefore a main object of the present invention to provide bracket-supporting standards which also connect wall panels together.

It is another object of the present invention to provide a bracket-supporting standard which can be used in an easily altered display set-up.

It is a further object of the present invention to provide a wall-mounted bracket-supporting standard which connects two perpendicularly oriented panels together.

It is yet another object of the present invention to provide a versatile bracket-supporting wall standard.

These together with other objects and advantages which will become subsequently apparent reside in the details of construction and operation as more fully hereinafter described and claimed, reference being had to the accompanying drawings forming part hereof, wherein like numerals refer to like parts throughout.

DETAILED DESCRIPTION OF THE INVENTION

Figure 1:
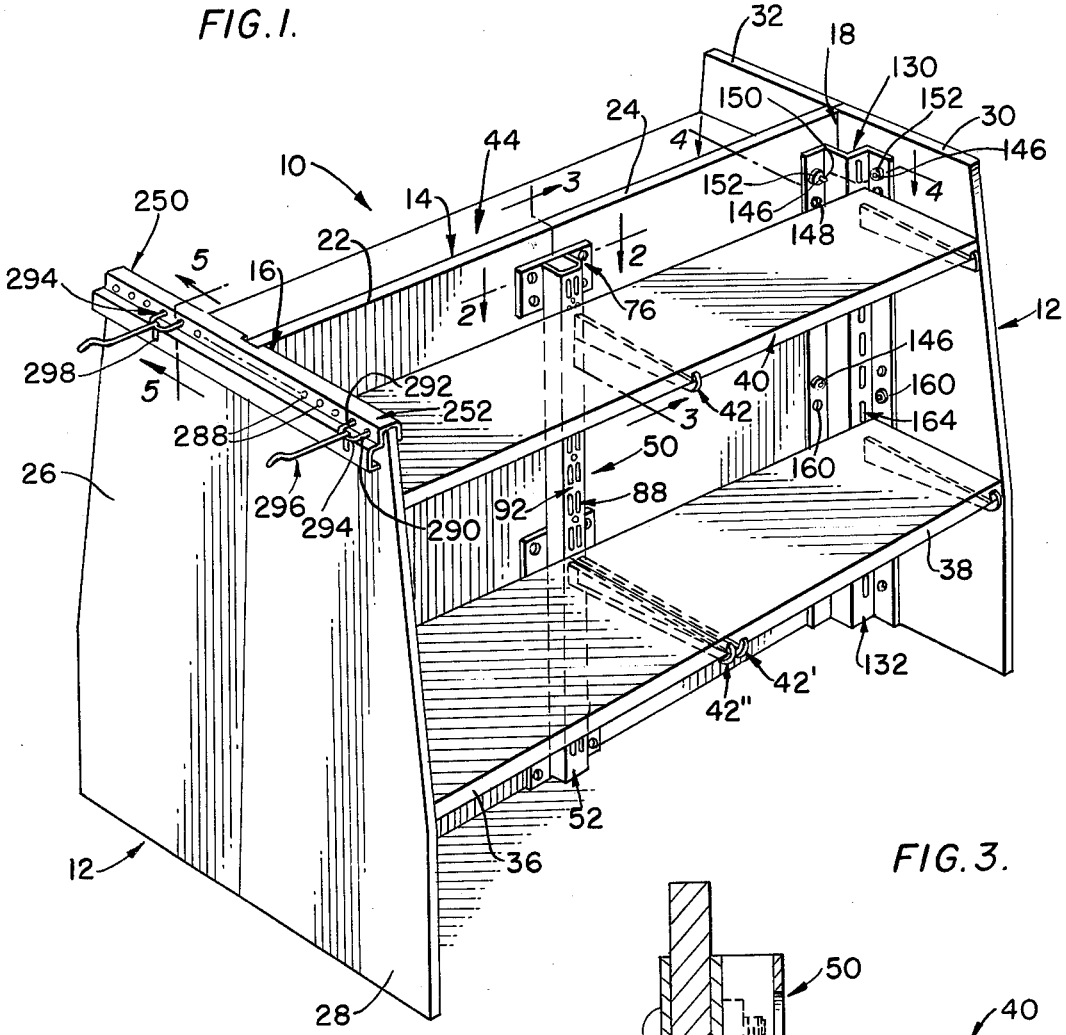
FIG. 1 is a perspective view of a display set-up showing the various bracket-supporting standards embodying the teachings of the present invention.

Shown in FIG. 1 is a display set-up utilizing three forms of the wall-attaching bracket-supporting standards embodying the teachings of the present invention. The display set-up includes a cabinet assembly 10 having a pair of essentially parallel side wall assemblies 12 supporting and supported by a cross-wall assembly 14 which is oriented to intersect the side walls 12 at essentially right angles to form corners 16 and 18. The side wall and cross-wall assembly are composed of a plurality of panels, such as panels 22, 24, 26, 28, 30, and 32, each being of any suitable composition or design.

A plurality of horizontally oriented shelves such as shelves 36, 38, and 40 are supported by brackets such as bracket 42, which are releasably supported on the walls to extend horizontally outward therefrom by the standards embodying the teachings of the present invention. Further shelves, such as shelf 44, can be supported on the back of the assembly 10 in a manner similar to that manner of supporting shelves 36 through 40.

Figure 2:
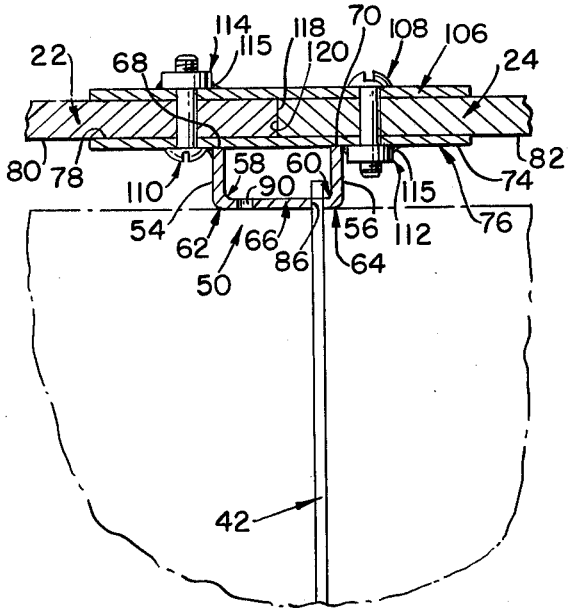
FIG. 2 is a plan view taken along line 2—2 in FIG. 1.
Figure 3:
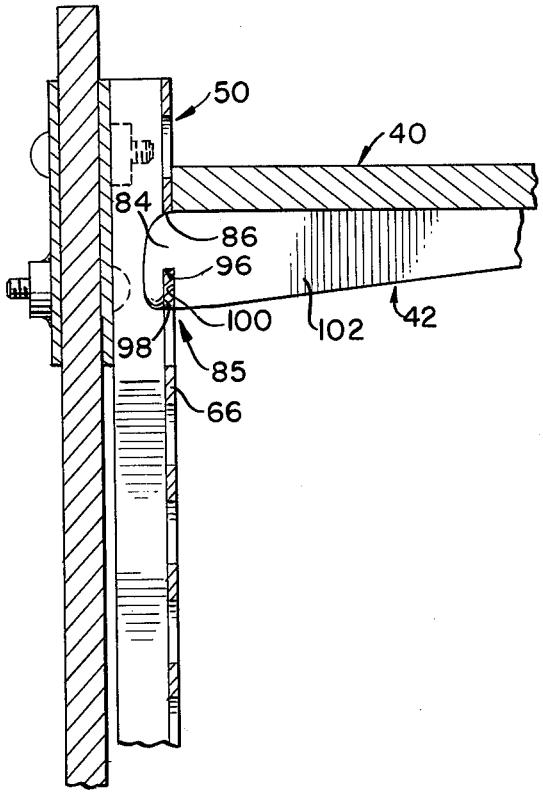
FIG. 3 is an elevation view taken along line 3—3 of FIG. 1.

One form of a standard embodying the present invention is best shown in FIGS. 1, 2 and 3, and is denoted by the numeral 50. The standard 50 comprises an elongate body 52 which is channel-shaped in transverse cross-section and has a pair of elongate side walls 54 and 56 attached at their edges 58 and 60 to side edges 62 and 64 of elongate front wall 66 of the body 52. Selected portions of the opposite edges 68 and 70 of the side walls 54 and 56 are suitably attached, as by welding, to a front face 74 of an anchor plate, such as anchor plate 76, having a rear face 78 flush-fit against front faces 80 and 82 of the wall panels 22 and 24, respectively. The anchor plate can be attached to the body in a position suitable to accommodate panels having various heights, or attached to the body after the panel height has been determined, or the like.

The attachment can be by welding, bolting or the like, and can be selected so that the anchor plate can easily be attached to the standard at the proper location to accommodate the panels of a wall of any particular height. The means of attaching the anchor plate to the standard can also be selected so that attachment is not difficult and can be effected by a semi-or-unskilled person.

The side walls 54 and 56 have a width sufficient to space front wall 66 far enough away from anchor plate face 74 to accommodate hooking finger 84 of bracket interlock means 85 so that finger 84 is releasably interlocked to standard 50 by engagement through a slot 86, which is one of a plurality of slots which are vertically aligned to form a first row 88 of slots. A plurality of slots 90 are defined in front wall 66 to be vertically aligned and to form a row 92 which is spaced from and essentially parallel with the row 88 of slots 86, as shown in FIGS. 1 and 2. The interlock means 85 is shown in FIG. 3 as comprising downwardly turned hooking finger 84 having a slot 96 separating hooking finger front surface 98 from rear surface 100 of bracket body 102 a distance sufficient to accommodate front wall 66 between the cooperating opposed interlock surfaces 98 and 100. However, other forms of the bracket engaging means can be used.

The twin parallel rows 88 and 92 permit side-by-side placement of brackets, such as shown for brackets 42' and 42" to enable shelves of varying lengths to be supported in the assembly 10. Thus, as shown in FIG. 1, two shelves, such as shelves 36 and 38 can be supported on the side-by-side brackets 42' and 42", or one shelf, such as shelf 36, can be omitted, as desired, or a single shelf, such as shelf 40, can be doubly supported by the side-by-side brackets.

As shown in FIG. 2, a backing plate 106 cooperates with anchor plate 76 to hold the standard 50 on the walls 22 and 24. Oppositely directed anchor bolts, such as bolts 108 and 110, are threadably connected to threaded anchor nuts 112 and 114, respectively, which nuts are affixed, as by welding, indicated by numerals 115 in FIG. 2, to anchor plate 74 and backing plate 106, respectively. The bolts and nuts are in pairs as shown in FIGS. 1 and 2, and can be inserted through predrilled holes in panels 22 and 24, respectively. The pairs are preferably arranged so that diagonally opposite bolts are oriented in the same direction, and co-level bolts, such as bolts 110 and 112, are oriented to be oppositely directed.

As shown in FIG. 2, the anchoring connection of the standard 50 connects the panels 22 and 24 together so that edges 118 and 120 are in abutting contact. Thus, the panels are connected together via the standard 50. Attachment of the standard, and hence connection of the panels together, is quite easily effected by simply threading the bolts 108 and 110 through the predrilled holes in the panels, and into the threaded anchor nuts 112 and 114. The brackets 42 can then be suitably positioned on the standard via the interlock means 85 and the slots 86 and/or 90 to properly orient the shelves in the assembly 10.

The standard can also be attached to a single panel, or wall, The standard can also be mounted on a wall by substituting self-tapping screws for the bolts, such as bolts 110 and 112, and omitting the anchor bolts and the backing plate 106.

The standard 50 is shown in FIGS. 1 through 3 as being substantially vertically oriented, however, other orientations are possible without departing from the teachings of the present invention.

Figure 4:
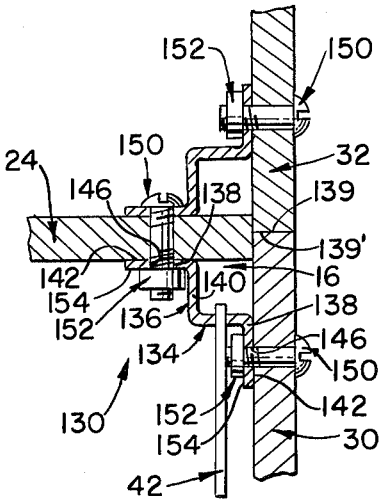
FIG. 4 is a plan view taken along line 4—4 of FIG. 1.

A corner bracket 130 forms a second embodiment of the present invention, and is best shown in FIGS. 1 and 4 as comprising an elongate body 132 having two L-shaped halves 134 and 136 joined along one of their edges to form a zig-zag configuration. Each of the halves is similar to the other, and comprises a base 138 and a back 140. The bases 138 each forms a panel engaging flange and has a panel engaging surface 142 thereon. The edges along which the two halves are joined form an axis of symmetry which extends longitudinally of the standard.

In the form shown in FIGS. 1 and 4, a plurality of aligned holes, such as holes 146 and 148, are defined in each of the bases 138 through which anchoring bolts, such as bolt 150, are received. The bolts are threadably received in threaded anchor nuts, such as nut 152, which are each attached, as by welding, to base outer face 154 to connect the panel 30 and the corner standard 130. Self-tapping screws, such as screws 160 (FIG. 1) can be inserted through holes 148 to attach a single standard to a panel without requiring an anchor nut to be positioned on the other side of the panel. Alternatively, bolts can be inserted through holes 148 and into threaded engagement with anchor nuts which are not attached to a flange of a corner standard. The non-attached nuts can couple a standard to the wall, or simply be seated against the wall directly (or via a washer, as desired).

Thus, panels 24 and 30 can be connected together in a variety of ways to form a corner 16. Thus, bolts and anchor nuts can be connected, or self-tapping screws can be used, or a bolt and a non-attached nut combination can be used wherein a screw or bolt is inserted through a hole such as hole 148, and suitably secured to panel 24. Panel 32 can be attached to panel 24 in a similar manner. Furthermore, by using a pair of corner brackets, such as shown in FIG. 4, the panels 30 and 32 can be connected to each other and to the panel 24 via corner brackets 130 to form the T-shaped intersection shown in FIGS. 1 and 4. As shown, panels 30 and 32 have their adjacent edges 139 and 139' in abutting contact in a manner similar to the abutting contact between panels 22 and 24 shown in FIG. 2.

Back 140 of the standard 130 has defined therein a plurality of aligned slots 164 for receiving the interlock means of the brackets. The other back 136 of the standard is preferably blank, but can have slots defined therein in a manner similar to the slots 164 for supporting brackets to be oriented outwardly of the side walls in a manner similar to the outward orientation provided for brackets 42 shown in FIGS. 1 and 4. The standard 130 is shown to be vertically oriented, however, other orientations can also be used without departing from the teachings of this invention.

It is also noted that the particular orientation of holes 146 and 148 shown in FIGS. 1 and 4 is exemplary and not intended to be limiting. Thus, hole 148 can be oriented to be above hole 146, or one of the holes can be staggered, or omitted completely, without departing from the teachings of the present invention.

Figure 8:
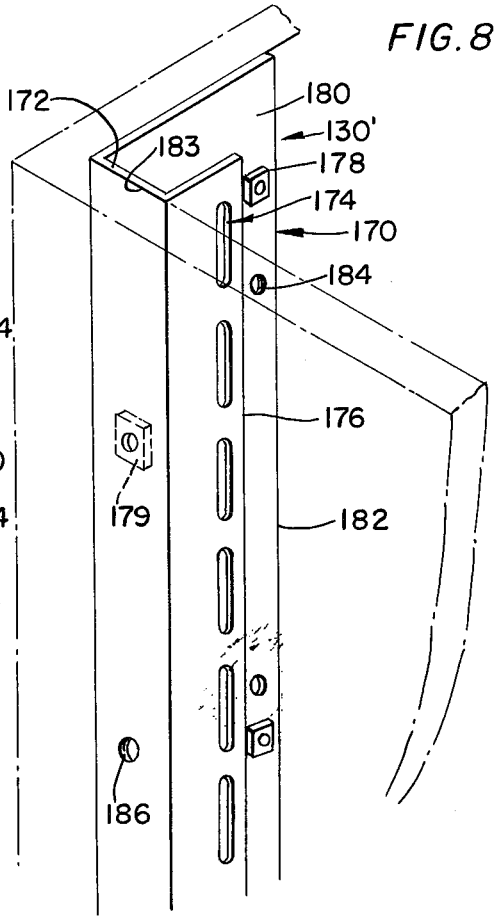
FIG. 8 is a perspective view of another embodiment of a bracket-supporting standard embodying the teachings of the present invention.

Another corner bracket 130' is shown in FIG. 8 as comprising an elongate body 170 which is essentially J-shaped in transverse cross-section with bight 172 being essentially flat. A plurality of aligned slots such as slot 174 are defined in short leg 176 of the body 170 which forms a front wall of the standard, and anchor nuts, such as anchor nuts 178 and 179, are affixed, as by welding, to face 180 of long leg 182 of the body 170 which forms a back wall of the standard, and to face 183 of the bright portion of the bracket, respectively. A plurality of threaded holes, such as holes 184 and 186, are defined in bight 172 (which forms a side wall of the standard) and long leg 182, respectively, for receiving therethrough anchor bolts (not shown) to attach standard 130' to a pair of intersecting panels to form a corner, such as shown in FIG. 8. Attaching means, such as screws, bolts, or the like, can be threaded through the holes in the panels to engage either the holes 184, 186 or the anchor nuts 178 to connect the panels and the standard 130'. Thus, a pair of conjugate standards can be attached in a manner similar to those conjugate standards shown in FIG. 4, or by using self-tapping screws, the standard 130' can be attached directly to the panels, as above described. Brackets are then engaged in the slots to support the shelves as was also described above.

Figure 7:
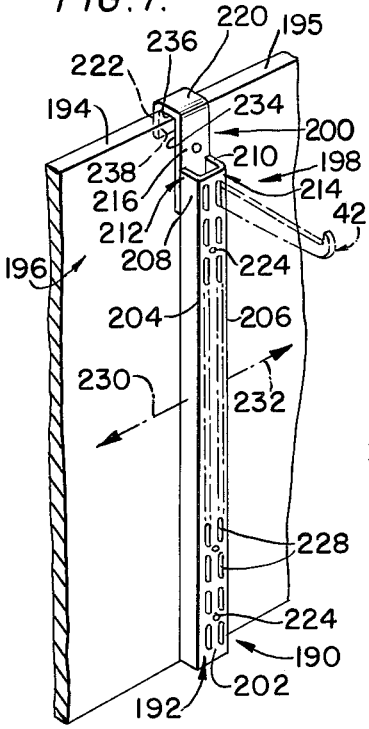
FIG. 7 is a perspective view of another bracket-supporting standard embodying the teachings of the present invention.

Another standard is shown in FIG. 7 and is denoted by the numeral 190, and comprises an elongate body 192 pendently suspended from top 194 and/or 195 of panels 196 and 198 by a hanger means 200. The body 192 comprises a front wall 202 having side edges 204 and 206 from which side walls 208 and 210 extend into contact with the front faces of th panels 196 and/or 198. The side walls of the elongate body 192 are each connected along top portions 212 and 214 to tail portion 216 of the hanger means 200. The hanger means is a hook which is in a form resembling an inverted J and having a top bight 200 being essentially flat and connected at one end to the tail portion 216 and at the other end to depending lip portion 222. The length of the bight 220 is approximately equal to the thickness of the panels so that the hook can slide along the top thereof to place the suspended standard in the desired position on the wall or panel. A plurality of screw-receiving holes 224 are defined in the front wall 202 so that attaching means, such as screws (not shown) can be inserted through the wall 202 and into the panels to attach the standard 190 to the wall or panels. A plurality of bracket-receiving slots 228 are defined in the front wall 192 to be aligned in a pair of essentially parallel rows, as in the standard 50 shown in FIGS. 1 through 3. Brackets, such as bracket 42, are mounted on the standard 190 in a manner similar to that manner described with respect to the standard.

The standard 190 is suspended from the top of a wall or panel, and then moved along that panel, as denoted by arrows 230 and 232 in FIG. 7, until the standard is properly positioned on the wall or panel. Then, anchor screws are inserted through holes 224, and the standard is secured to the wall or panel. Brackets can then be engaged in the slots 228, and shelves supported thereon.

Alternatively, adhesive means can be placed on inner surfaces 234, 236 and 238 of the hanger means tail, bight and lip portions, respectively, so that the hanger means is adhesively attached to the wall or panel. Other fastening means, such as self-tapping screws (not shown), can be threaded through holes in the hanger means to attach the hanger means, and hence the standard, to the wall of panel. The screws can be threaded through the tail portion 216, through the bight portion 220, or through the lip portion 222 into the panel or wall. The adhesive means, screws or other attaching means can be positioned on the hook so that the hook can be attached to two abuttingly contacting panels, such as panels 22 and 24, so that those panels are connected together via the standard 190. Such attachment and connection is easy as the screws, or the like, are easily reached. Furthermore, cushioning material can be inserted between the inner surfaces 234 through 238 and the wall or panel to prevent the hanger from marring the finish of a finished wall or panel as that hanger is moved along the top thereof.

Figure 5:
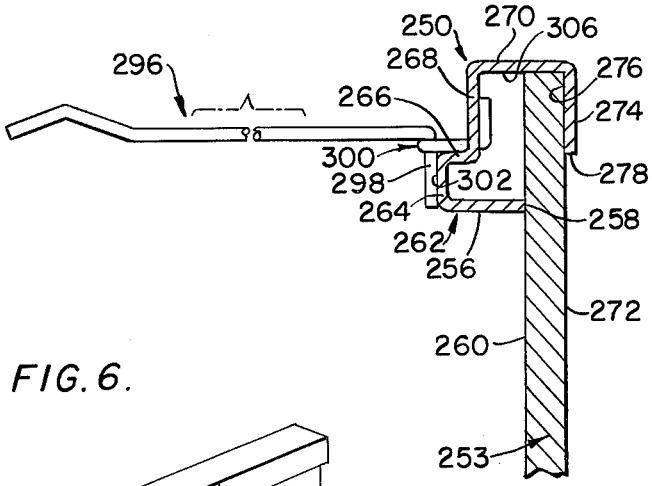
FIG. 5 is a view in elevation taken along line 5—5 of FIG. 1.
Figure 6:
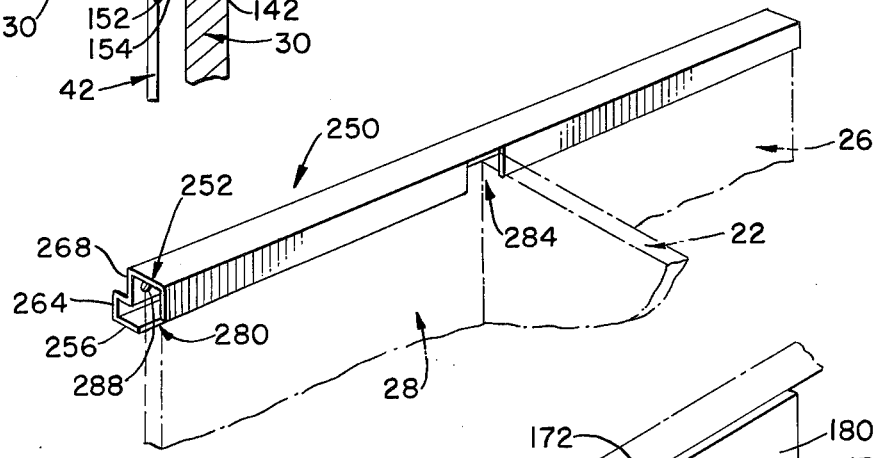
FIG. 6 is a perspective view of a hanger support.

A horizontally mounted standard is shown in FIGS. 1, 5 and 6, and is denoted by numeral 250. The standard 250 comprises an elongate body 252 which is shaped in the form of a block-L in transverse cross-section. Thus, as shown in FIG. 5, the body 252 is suspended from the top of a panel 253 and comprises an essentially horizontal bottom portion 256 having a panel engaging edge 258 engaing front face 260 of the panel 253 and extending outwardly therefrom. An offset portion 262 comprises an essentially vertical front face 264 extending upwardly from bottom 256 and an essentially horizontal leg 266 extending toward face 260 of the panel 253 from the top edge of face 264 to a position between the front face 264 and panel 260. A front wall 268 is essentially vertical and extends upwardly from leg 266, and a top portion 270 is essentially horizontal and extends toward face 260 of the panel 253, and to a position immediately adjacent back face 272 of the panel 253, where a lip portion 274 depends in an essentially vertical direction toward bottom portion 252. The lip portion 274 has an inner panel engaging surface 276 fitting flush against rear surface 272 of the panel 253 and a lower edge 278 which is located at a position between top portion 270 and bottom portion 252 to define a panel receiving opening 280 (FIG. 6) therebetween. As shown in FIG. 5, the panel is received in opening 280 to be wedged between lip surface 276 and panel engaging surface 258 so that standard 250 straddles the panel 253 across the top thereof to support the standard 250 on the panel 253 in an essentially horizontal orientation.

Lip 274 can have a notch 284 defined therein for receiving a panel, such as panel 22 shown in FIGS. 1 and 6, and has a plurality of peg-board-like holes 288 (FIGS. 1 and 6) defined in front wall 268. The holes 288 are aligned and positioned with resepct to each other so that pairs of adjacent holes can receive legs 290 and 292 of a mounting ring 294 which mounts a hanger rod 296 on the standard 250. The hanger rod extends outwardly from front wall 268 and has a downturned leg 298 fixed, as by welding, to front portion 300 of the mounting ring 294. The leg 298 is engaged against front surface 302 of front wall 264 to lock the hanger rod 296 in horizontal orientation shown in FIGS. 1 and 5 so that the hanger rod extends outwardly from the panel 253. The hanger rods 296 can be used to support shelves or can be used to support other hanging items, and are locked into position by the wedging attachments between the legs 298 and the offset portion front face 264, as well as by the secure connection between the legs 298 and the mounting rings 294. Fastening means can be used to fasten the standard 250 to the top of a panel by threading self-tapping screws or the like, through lip portion 274 into the panel 253, or through top portion 270 into the top edge of the panel 253, or through front face 264. In a manner similar to that used in conjunction with the above discussed standards, two panels, such as panels 26 and 28, can be connected together via the standard 250. Thus, suitably placed screws can connect panels 26 and 28 to the standard 250, and hence, to each other.

Alternatively, adhesive material can be positioned on the inner surfaces 306 and 276 of the standard top and lip portions respectively to adhesively attach the standard to the panel in a manner similar to that manner in which the FIG. 7 standard is attached to the wall or panel shown in that Figure. Furthermore, cushioning material can also be inserted between the standard and the wall top to prevent a finished panel or wall surface from being marred by the standard.

Figure 9:
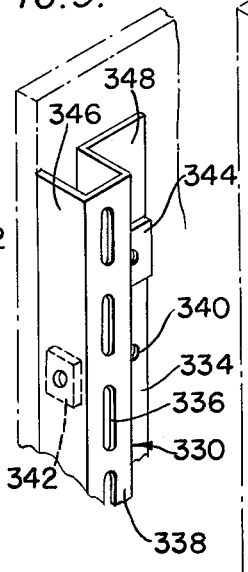
FIG. 9 is a perspective view of another embodiment of a bracket-supporting standard embodying the teachings of the present invention.

Yet another standard is shown in FIG. 9 and comprises a U-shaped portion 330 having a flange portion 334 extending therefrom. Vertically aligned slots 336 are defined in bight portion 338 of the U-shaped portion and threaded holes, such as hole 340, are defined in the flange portion to receive screws to attach the standard to a wall, or walls. Anchor bolts, such as anchor bolts 342 and 344, are attached to the surfaces 346 and 348 of the bight and flange respectively to be adjacent bolt receiving holes for attaching the standard to a wall, or walls, by bolts. As with the other embodiments, a pair of wall can be connected together to be in abutting contact by the FIG. 9 standard. The walls will then form a corner, such as corners 16 and 18.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

What is claimed is:

1. A corner connector for joining together two panels to form a corner, comprising;

a first section, said first section being elongate and having a plurality of longitudinally spaced apart holes defined therethrough and a plurality of first anchor nuts affixed to said first section to be concentric with some of said spaced apart holes;

a second section, said second section being elongate and having one longitudinal edge thereof integrally connected to one longitudinal edge of said first section, said first and second sections being oriented with regard to each other to form a right angle;

a third section, said third section being elongate and having one longitudinal edge thereof integrally connected to another longitudinal edge of said second section, said second and third sections being oriented with regard to each other to form a right angle; and a fourth section, said fourth section being elongate and having a plurality of longitudinally spaced apart holes defined therethrough and a plurality of second anchor nuts affixed to said fourth section to be concentric with some of said fourth section spaced apart holes and having one longitudinal edge thereof integrally connected to another longitudinal edge of said third section, said third and fourth sections being oriented with regard to each other to form a right angle, said first and third sections being in spaced parallelism and said second and fourth sections being in spaced parallelism, said first and second anchor nuts being located adjacent alternating holes so that a fastening member inserted through one of said first section holes is aligned with one of said second anchor nuts whereby a fourth section of one connector is attached to a first section of another connector by inserting a fastener through a hole in the first section of the one connector and connecting that fastener to an anchor nut in said fourth section of the another connector whereby a pair of panels can be connected together so that those panels form a corner.

2. A corner connector for joining together two panels to form a corner, comprising:

a pair of first elongate sections, each of said first sections having a plurality of longitudinally spaced apart fastening holes defined therethrough and a plurality of anchor nuts attached to said each section to be concentric with some of said fastening holes, said fastening holes on each first section having a corresponding fastening hole in the other section with said corresponding fastening hole having an anchor nut associated therewith so that a fastening member inserted through a fastening hole in one section will be aligned with an anchor nut on the other section, said pair of first sections being oriented at right angles with respect to each other and to extend away from each other; and a pair of second elongate sections, said second sections being integrally connected together along one longitudinal edge of each section and forming a right angle, each one of said second elongate sections being integrally connected along the other longitudinal edge thereof to a longitudinal edge of one of said first elongate sections, the connected ones of said first and second elongate sections forming right angles so that one section of said first section is in spaced parallelism with one section of said second elongate section so that wall panels can be connected together by fastening members connecting a first elongate section of one connector to a first elongate secion of another connector via fastening holes in said sections and an anchor nut in one of said sections whereby a pair of panels can be connected together so that those panels form a corner.

3. The corner connector of claim 2, further including spaced apart bracket connections defined in one of said second and third elongate sections for detachably holding brackets on the standard.

4. The corner connector of claim 2, wherein said anchor nuts are welded to said elongate sections.

5. The corner connector of claim 1, wherein said first and fourth sections each has an inner face and said anchor nuts are located on said inner faces.

6. The corner connector of claim 5, wherein the corner formed by said second and third sections is located between said inner faces so that said corner formed by said second and third sections is spaced apart from the panels connected together by the connector.

* * * * *